US006512326B1

(12) United States Patent
Arai et al.

(10) Patent No.: US 6,512,326 B1
(45) Date of Patent: Jan. 28, 2003

(54) COLOR CATHODE-RAY TUBE

(75) Inventors: Shinji Arai, Shiga (JP); Hiroshi Hasegawa, Shiga (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/500,440

(22) Filed: Feb. 9, 2000

(30) Foreign Application Priority Data

Feb. 10, 1999 (JP) ..... 11-032301

(51) Int. Cl.[7] ..... H01J 29/80
(52) U.S. Cl. ..... 313/407; 313/408
(58) Field of Search ..... 313/402, 407, 313/408

(56) References Cited

U.S. PATENT DOCUMENTS 3,808,493 A * 4/1974 Kawamura et al. ..... 313/85
5,742,116 A * 4/1998 Maki et al. ..... 313/402
6,246,164 B1 * 6/2001 Heyman et al. ..... 313/407

FOREIGN PATENT DOCUMENTS

FR 87-4485 5/1987
FR 96-42882 12/1996

* cited by examiner

*Primary Examiner*—Sandra O'Shea
*Assistant Examiner*—Ali Alavi
(74) *Attorney, Agent, or Firm*—Sughrue Mion, PLLC

(57) ABSTRACT

A color cathode-ray tube is provided with constitution between a shadow mask electrode and a frame body such that difference of expansion and contraction between the shadow mask electrode and the frame body according to heat brings no-picture quality deterioration with practical cost. The shadow mask electrode made of metal whose thermal expansion rate is low. The shadow mask electrode is supported by a shadow mask electrode supporting body made of metal whose thermal expansion rate is approximately the same as that of the shadow mask electrode. The shadow mask electrode supporting body is supported by a frame body made of metal whose thermal expansion rate is different from that of the shadow mask electrode.

31 Claims, 8 Drawing Sheets

COLOR CATHODE-RAY TUBE

BACKGROUND OF THE INVENTION

The present invention relates to a color cathode-ray tube. More to particularly, this invention relates to structure of a shadow mask electrode and a shadow mask electrode supporting body which influence picture quality of the color cathode-ray tube.

DESCRIPTION OF THE PRIOR ART

In the color cathode-ray tube, the greater parts of electron beam meet a shadow mask electrode. Accordingly, temperature of the shadow mask electrode rises. Temperature rise deforms shadow mask electrode caused by thermal expansion. Picture quality deterioration occurs according to this deformation. It is necessary to prevent picture quality deterioration caused by the deformation. In order to prevent the picture quality deterioration, formerly, fixed tension is applied to the shadow mask electrode. The shadow mask electrode is fastened to a frame while applying fixed tension thereto.

In recent years, requirement with respect to picture quality becomes increasingly severe. For that reason, metal whose coefficient of thermal expansion is low such as Invar is used so that it is capable of reducing thermal expansion of the shadow mask electrode itself to the utmost.

Above-mentioned conventional techniques are combined with each other. Namely, the shadow mask electrode is made of metal such as Invar whose coefficient of thermal expansion is low. Tension is applied to the shadow mask electrode made of Invar in order to fasten it flatly to a supporting body. A frame body is made of the same metal as that of the shadow mask electrode. The shadow mask electrode is fastened to the frame body while applying fixed tension thereto. The thermal expansion rate of shadow mask electrode agrees with the thermal expansion rate of the frame body. It is capable of obtaining a color cathode-ray tube with very excellent picture quality.

However, the metal whose thermal expansion rate is low is very expensive. It is very expensive when the frame body is made of the metal with low thermal expansion rate. It is not practical. Consequently, as a practical method, the shadow mask electrode is made of metal whose thermal expansion rate is low such as Invar and so forth but expensive. The frame body is made of metal whose thermal expansion rate is high such as steel and so forth but cheap. Thus it can be considered that the shadow mask electrode made of metal with low rate of thermal expansion is combined with the frame body made of metal with high rate of thermal expansion.

However, such combination brings picture quality deterioration. The combination between the shadow mask electrode and the frame body with difference of thermal expansion rate described above brings difference of expansion and contraction between the shadow mask electrode and the frame body. Such combination brings shears, wrinkles, slackening and so forth from design dimension of the shadow mask electrode. Such wrong condition occurs either in temperature (about 400 to 500° C.) during manufacturing of color cathode ray tube, and in temperature (about 50 to 100° C.) in use of the color cathode ray tube.

SUMMARY OF THE INVENTION

In view of the foregoing, it is an object of the present invention, in order to overcome the above-mentioned problems to provide a color cathode-ray tube which provides constitution both of a shadow mask electrode and a frame body in which difference of expansion and contraction between the shadow mask electrode and the frame body does not produce picture quality deterioration with practical cost.

In accordance with a first aspect of the present invention, in order to achieve the above mentioned object, there is provided a color cathode-ray tube which comprises a shadow mask electrode made of metal whose thermal expansion rate is low and to which tension is applied to be flatly supported, a color electrode supporting body made of metal whose thermal expansion rate is approximately the same as that of the shadow mask electrode, for supporting shadow mask electrode, and a frame body made of metal whose thermal expansion rate is different from that of the shadow mask electrode, for supporting the shadow mask electrode supporting body.

According to the first aspect, the shadow mask electrode and the shadow mask electrode supporting body are made of approximately the same metal whose thermal expansion rate is low. Relative difference of dimension between the shadow mask electrode and the shadow mask electrode supporting body is small in relation to temperature change. It is capable of preventing picture quality deterioration caused by shear, wrinkle, or slackening from design dimension of the shadow mask electrode in use or during manufacturing of the color cathode-ray tube. Further, the frame body is made of metal whose price is low, thus it is capable of constituting the color cathode ray tube in low cost.

In accordance with a second aspect of the present invention, in the first aspect, there is provided a color cathode-ray tube wherein tension in one-way direction is applied to the shadow mask electrode to be flatly supported.

As described-above according to the second aspect, since the tension in one-way direction is applied to the color section electrode, it is capable of being prevented the picture quality deterioration caused by shear, wrinkle, or slackening of the shadow mask electrode due to stress-strain convergence at the corner part of the shadow mask electrode.

In accordance with a third aspect of the present invention, in the second aspect, there is provided a color cathode-ray tube, wherein tension in one-way direction is applied to the shadow mask electrode to be flatly supported, and there is provided the shadow mask electrode supporting body for only two sides which stand opposite each other for applying tension to said shadow mask electrode.

As described above, according to the third aspect, since there is provided a color cathode-ray tube, wherein tension in one-way direction is applied to the shadow mask electrode to be flatly supported, and there is provided the shadow mask electrode supporting body for only two sides which stand opposite each other for applying tension to said shadow mask electrode. Thus, it is capable of prevented the picture quality deterioration caused by shear, wrinkle, or slackening of the shadow mask electrode due to stress-strain convergence at the corner part of the shadow mask electrode.

In accordance with a fourth aspect of the present invention, a color cathode-ray tube which comprises a shadow mask electrode made of metal whose thermal expansion rate is low and to which tension in one-way direction is applied to be flatly supported, color electrode supporting bodies consisting of different kind of metals, one metal whose thermal expansion rate is approximately the same as that of the shadow mask electrode for supporting shadow mask electrode in one-way direction, and the other metal whose thermal expansion rate is different from that of the shadow mask electrode does not support the shadow mask electrode, and a frame body made of metal whose thermal expansion rate is different from that of the shadow mask electrode, for supporting the shadow mask electrode supporting body.

As described-above according to the fourth aspect, since the shadow mask electrode supporting body which does not apply tension to the shadow mask electrode is made of metal whose thermal expansion rate is different from that of the shadow mask electrode, the shadow mask electrode is made of metal whose price is low resulting in cost down.

In accordance with a fifth aspect of the present invention, there is provided a color cathode-ray tube which comprises a shadow mask electrode made of metal whose thermal expansion rate is low and to which tension in one-way direction is applied to be flatly supported, color electrode supporting bodies made of metal whose thermal expansion rate is approximately the same as that of the shadow mask electrode for supporting shadow mask electrode in one-way direction, and a frame body made of metal whose thermal expansion rate is different from that of the shadow mask electrode, for supporting the shadow mask electrode supporting body, and whose extended part comes into contact with the shadow mask electrode in different part from one-way direction supported part in order to support it.

As described-above, according to the fifth aspect, sides of the shadow mask electrode, which tension is not applied are supported by extended part of the frame body, thus structure of the frame is more simplified further resulting in cost down.

In accordance with a sixth aspect of the present invention, in any of the first to fifth aspects, there is provided a color cathode-ray tube, wherein shape of the shadow mask electrode is plane.

As described above, according to the sixth aspect, it is capable of realizing plane type color cathode-ray tube whose image is easy to see and without distortion because shape of the shadow mask electrode is plane.

In accordance with a seventh aspect of the present invention, in any of the first to fifth aspect, there is provided a color cathode-ray tube, wherein shape of the shadow mask electrode is a part of side surface of a cylinder.

As described-above, according to the seventh aspect, it is capable of realizing the color cathode-ray tube which is easy to see and a low cost because shape of the shadow mask electrode is a part of cylinder side face.

In accordance with an eighth aspect of the present invention, in any of the first to seventh aspect, there is provided a color cathode-ray tube, wherein shape of the frame body is rectangular.

As described-above, according to the eighth aspect, the structure of the frame body is simplified to be miniaturized thus resulting in light weight.

In accordance with a ninth aspect of the present invention, in any of the first to the eighth aspect, there is provided a color cathode ray tube, wherein the frame body is approximately rectangular with section which a part of section and/or the whole of section is L-shape.

As described-above, according to the ninth aspect, the frame body is miniaturized to be light weighted because distortion resistance becomes high because the frame body is approximately rectangular with section which a part of section and/or the whole of section is L-shape.

In accordance with a tenth aspect of the present invention, in any of the first to eighth aspect, there is provided a color cathode-ray tube, wherein the frame body has approximately rectangular with section which a part of section and/or the whole of section is L-shape, and there are provided embosses in a part of said frame body and/or in the whole of said frame body.

As described-above, according to the tenth aspect, the frame body is difficult to be deformed because the frame body has approximately rectangular with section which a part of section and/or the whole of section is L-shape, and there are provided embosses in a part of said frame body and/or in the whole of said frame body. The frame body is miniaturized and lightened.

In accordance with an eleventh aspect of the present invention, in any of the first to eighth aspect, there is provided a color cathode-ray tube, wherein the frame body has rectangular shape with section which a part of section and/or the whole of section is triangular shape.

As described-above, according to the eleventh aspect, the frame body is difficult to be deformed because the frame body has approximately rectangular with section which a part of section and/or the whole of section is triangular shape, and there are provided embosses in a part of said frame body and/or in the whole of said frame body. The frame body is miniaturized and lightened.

In accordance with a twelfth aspect of the present invention, in any of the first to eighth aspect, there is provided a color cathode-ray tube, wherein there is provided a reinforcing member on a part of the frame body and/or the whole of the frame body.

As described-above, according to the twelfth aspect, there is provided a color cathode-ray tube wherein the frame body is difficult to be deformed because the frame body has approximately rectangular with section which a part of section and/or the whole of section is provided with reinforcing member. The frame body is miniaturized and lightened.

In accordance with a thirteenth aspect of the present invention, there is provided a color cathode-ray tube, wherein a part of the frame body and/or the whole of said frame body is manufactured by stamping out press processing.

As described-above, according to the thirteenth aspect, it is capable of manufacturing the frame body with short time and low cost because a part of the frame body and/or the whole of said frame body is manufactured by stamping out press processing.

In accordance with a fourteenth aspect of the present invention, there is provided a color cathode-ray tube, wherein a shape of two sides which stand opposite each other and to which tension is applied is different from a shape of the two sides which stand opposite each other and to which no-tension is applied.

As described-above, according to the fourteenth aspect, since it causes a shape of two sides which stand opposite each other and to which tension is applied to be different from a shape of the two sides which stand opposite each other and to which no-tension is applied. It is capable of executing a scheme closely for the sake of intention reinforcing for the former requiring intensity, while it is capable of simplifying intention reinforcing for the former which requires weak intensity in comparison with the later. It is capable of executing cost down, miniaturization, and/or light weighing of the frame body.

In accordance with a fifteenth aspect of the present invention, there is provided a color cathode-ray tube, wherein the shadow mask electrode and the shadow mask electrode supporting body which applies tension to the shadow mask electrode are made of nickel-iron alloy including nickel of 34% to 40% and a slight amount of addition elements, and the frame body and the shadow mask electrode supporting body which applies no-tension to the shadow mask electrode are made of steel and/or stainless steel.

As described-above, according to the fifteenth aspect, the shadow mask electrode and the shadow mask electrode supporting body which applies tension to the shadow mask electrode are made of nickel-iron alloy including nickel of 34% to 40%, and the frame body and the shadow mask electrode which applies no-tension to the shadow mask electrode are made of steel and/or stainless steel. Therefore, it is capable of preventing picture quality deterioration because of low thermal expansion rate. The shadow mask electrode and the shadow mask electrode supporting body which applies tension to the shadow mask electrode have the same low thermal expansion rate. Further, the frame body and the shadow mask electrode which applies no-tension to the shadow mask electrode are difficult to be deformed enabling sufficient tension to be applied to the shadow mask electrode. Thus it is capable of realizing the color cathode-ray tube whose picture quality is very excellent with a low cost according to the synergistic effect thereof.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

Figure 15:
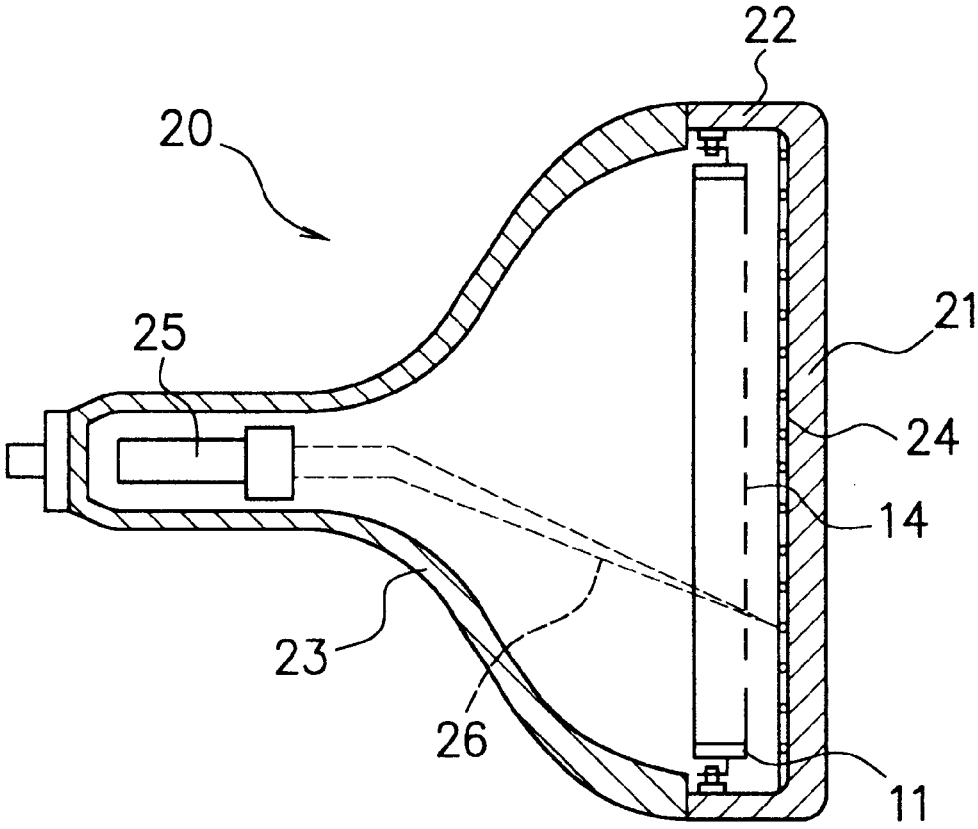
FIG. 15 is a whole view showing a color cathode-ray tube according to one embodiment of the present invention.

A preferred embodiment of the present invention will now be described in detail in accordance with the accompanying drawings. As shown in FIG. 15, a color cathode-ray tube 20 according to the present invention comprises a face panel 21, and a glass vacuum vessel consisting of a skirt 22 and a funnel 23. Phosphors 24 of red, green, and blue are arranged regularly on the inside face of the face panel 21. An electron gun 25 of rear part of the funnel 23 emits electron beam 26. The electron beam 26 passed through the shadow mask electrode 14, causes the phosphor 24 to emit light. The shadow mask electrode 14 is maintained on the inside of the skirt 22 by the frame body 11. The present invention relates to both of the shadow mask electrode 14 and the frame body 11.

Figure 1:
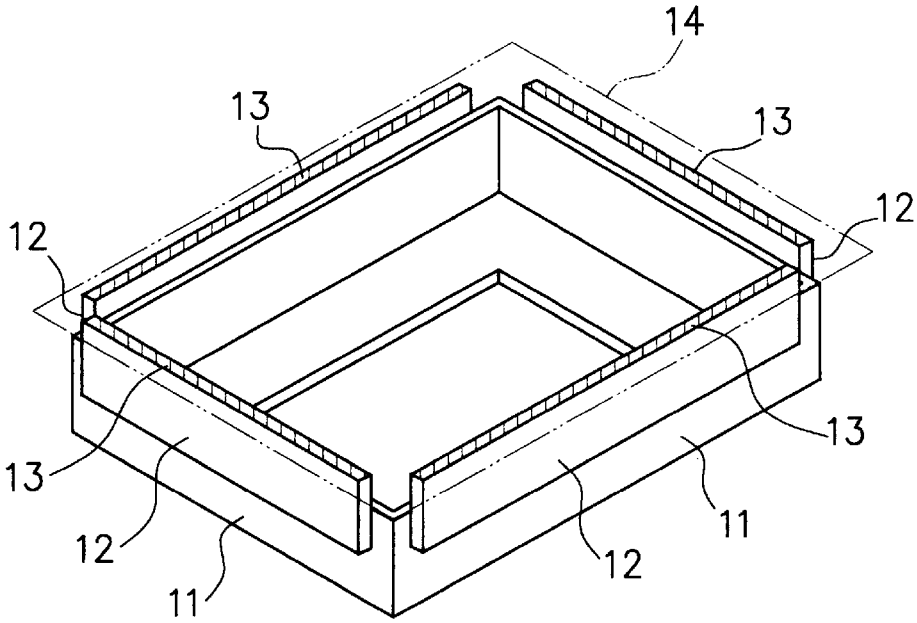
FIG. 1 is a perspective view showing a first embodiment of combination among a shadow mask electrode, a shadow mask electrode supporting body and a frame body of the present invention.

FIG. 1 is a perspective view showing a first embodiment of combination among a shadow mask electrode, a shadow mask electrode supporting body and a frame body of a color cathode ray tube of the present invention. The frame body 11 is an approximately rectangular. The shadow mask electrode supporting body 12 is firmly fixed to be supported on the four-sides of the frame body 11. A part of the shadow mask electrode supporting body 12 is protruded upward from the frame body 11. The shadow mask electrode supporting body 12 is firmly fixed to be supported to the frame body 11 by resistance welding, laser welding, hard-solder, rivet fastening, or staking. The shadow mask electrode 14 is firmly fixed to be supported on the supporting part 13 (hatching part) to be upper end face of the shadow mask electrode supporting body 12 by spot welding. Furthermore, the shadow mask electrode 14 roofs the whole opening at upper surface of the frame body 11. However, two-dot chain line indicates only the periphery part of four-side of the shadow mask electrode 14 in order to make the drawing easy to see. The thermal expansion rate of the metal for the shadow mask electrode 14 is approximately identical with the thermal expansion rate of the metal for the shadow mask electrode supporting body 12. For instance, the shadow mask electrode 14 is made of Invar. The shadow mask electrode supporting body 12 is made of Invar too. According to this combination, the thermal expansion rate both thereof is low, matching both thereof is suitable therefore, it is appropriate combination. The frame body 11 is constituted by different metal from that of the shadow mask electrode 14 and the shadow mask electrode supporting body 12 with respect to the thermal expansion rate. The first embodiment causes tension to be applied to the shadow mask electrode 14 in the lengthwise direction and lateral direction. Thus the applied tension prevents wrinkles, slackening and so forth of the shadow mask electrode 14. For instance, it is appropriate to use 13-chrome stainless steel for the frame body 11 with respect to mechanical property and price.

Figure 2:
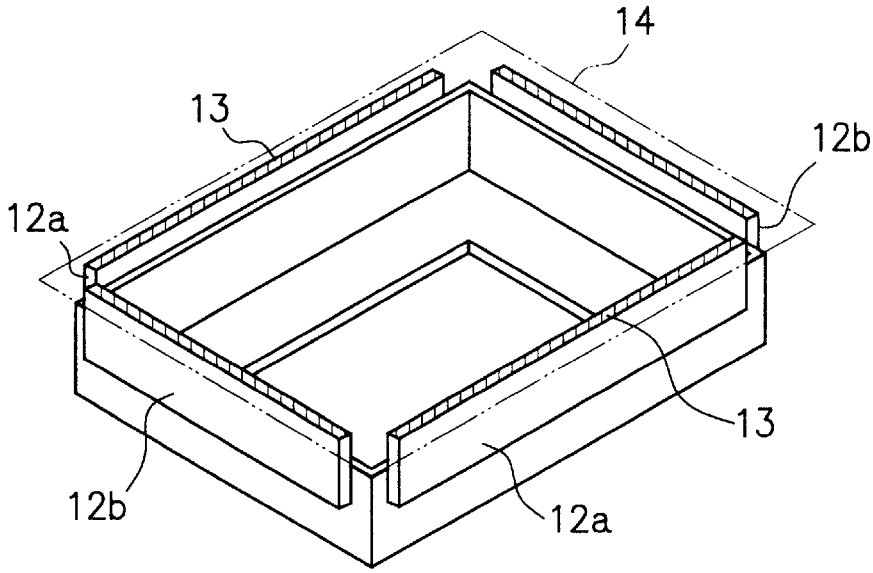
FIG. 2 is a perspective view showing a second embodiment of combination among a shadow mask electrode, a shadow mask electrode supporting body and a frame body of the present invention.

Next, FIG. 2 is a perspective view showing a second embodiment of combination among a shadow mask electrode, a shadow mask electrode supporting body and a frame body of a color cathode ray tube of the present invention. The frame body 11 is an approximately rectangular. The shadow mask electrode supporting body 12*a*, 12*b* is firmly fixed to be supported on the four-sides of the frame body 11. A part of the shadow mask electrode supporting body 12*a*, 12*b* is protruded upward from the frame body 11. The shadow mask electrode supporting body 12 is firmly fixed to be supported to the frame body 11 by resistance welding, laser welding, hard-solder, rivet fastening, or staking. The shadow mask electrode 14 is firmly fixed to be supported on the supporting part 13 (hatching part) to be upper end face of the shadow mask electrode supporting body 12*a*, 12*b* by spot welding. Furthermore, the shadow mask electrode 14 roofs the whole opening at upper surface of the frame body 11. However, two-dot chain line indicates only the periphery part of four-side of the shadow mask electrode 14 in order to make the drawing easy to see. The thermal expansion rate of the metal for the shadow mask electrode 14 is approximately identical with the thermal expansion rate of the metal for the shadow mask electrode supporting body 12*a*. The second embodiment is different from the first embodiment in that a supporting part 13 (hatching part) for the plane shaped shadow mask electrode 14 is two sides in the lengthwise direction as shown in FIG. 2. Tension is applied to the shadow mask electrode only in the lengthwise direction. The shadow mask electrode 14 is made of Invar. The shadow mask electrode supporting body 12*a* is made of Invar too. According to this combination, the thermal expansion rate both thereof is low, matching both thereof is suitable therefore, it is appropriate combination. On the other hand, in this case, the shadow mask electrode supporting body 12*b* in the lateral direction functions mainly of preventing oscillation of the shadow mask electrode 14. Accordingly, it is not necessary to adjust the thermal expansion rate of the shadow mask electrode 14 thereto. Consequently, it is appropriate to use 13-chrome stainless steel with a low price for the lateral direction of the shadow mask electrode supporting body 12*b*.

Figure 3:
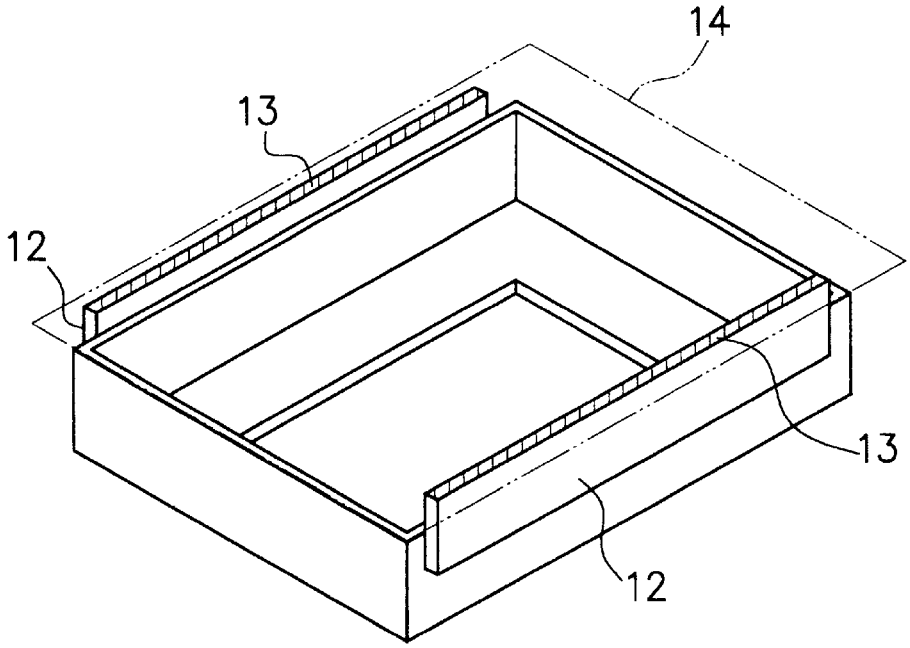
FIG. 3 is a perspective view showing a third embodiment of combination among a shadow mask electrode, a shadow mask electrode supporting body and a frame body of the present invention.

Next, FIG. 3 is a perspective view showing a third embodiment of combination among a shadow mask electrode, a shadow mask electrode supporting body and a frame body of a color cathode ray tube of the present invention. The frame body 11 is an approximately rectangular. The shadow mask electrode supporting body 12 is firmly fixed to be supported on the two-sides of the frame body 11. A part of the shadow mask electrode supporting body 12 is protruded upward from the frame body 11. The shadow mask electrode supporting body 12 is firmly fixed to be supported to the frame body 11 by resistance welding, laser welding, hard-solder, rivet fastening, or staking. The shadow mask electrode 14 is firmly fixed to be supported on the supporting part 13 (hatching part) to be upper end face of the shadow mask electrode supporting body 12 by spot welding. Furthermore, the shadow mask electrode 14 roofs the whole opening at upper surface of the frame body 11. However, chain line indicates only the periphery part of four-sides of the shadow mask electrode 14 in order to make the drawing easy to see. The thermal expansion rate of the metal for the shadow mask electrode 14 is approximately identical with the thermal expansion rate of the metal for the shadow mask electrode supporting body 12. A supporting part 13 (hatching part) for the plane shaped shadow mask electrode 14 is two sides in the lengthwise direction as shown in FIG. 3. Tension is applied to the shadow mask electrode only in the lengthwise direction. The shadow mask electrode 14 is made of Invar. There is no shadow mask electrode supporting body in the lateral direction. According to the third embodiment, it becomes possible to constitute the color cathode-ray tube with a low cost and lightweight.

Figure 4:
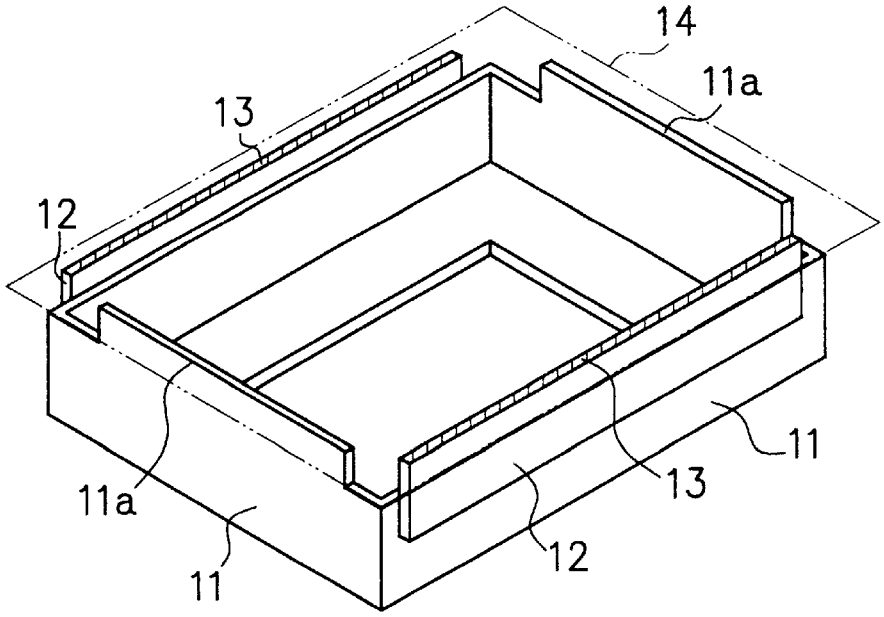
FIG. 4 is a perspective view showing a fourth embodiment of combination among a shadow mask electrode, a shadow mask electrode supporting body and a frame body of the present invention.

FIG. 4 is a perspective view showing a fourth embodiment of combination among a shadow mask electrode, a shadow mask electrode supporting body and a frame body of a color cathode ray tube of the present invention. The frame body 11 is an approximately rectangular. The shadow mask electrode supporting body 12 is firmly fixed to be supported on the two-sides of the frame body 11. A part of the shadow mask electrode supporting body 12 is protruded upward from the frame body 11. The shadow mask electrode supporting body 12 is firmly fixed to be supported to the frame body 11 by resistance welding, laser welding, hard-solder, rivet fastening, or staking. The shadow mask electrode 14 is firmly fixed to be supported on the supporting part 13 (hatching part) to be upper end face of the shadow mask electrode supporting body 12 by spot welding. Furthermore, the shadow mask electrode 14 roofs the whole opening at upper surface of the frame body 11. However, chain line indicates only the periphery part of four-side of the shadow mask electrode 14 in order to make the drawing easy to see. The thermal expansion rate of the metal for the shadow mask electrode 14 is approximately identical with the thermal expansion rate of the metal for the shadow mask electrode supporting body 12. A supporting part 13 (hatching part) for the plane shaped shadow mask electrode 14 is two sides in the lengthwise direction as shown in FIG. 4. Tension is applied to the shadow mask electrode only in the lengthwise direction. The shadow mask electrode 14 is made of Invar. In the fourth embodiment, upper part 11*a* in the lateral direction of the frame body 11 is extended upward direction so as to come into contact with the shadow mask electrode 14. Contact point thereof functions oscillation prevention of the shadow mask electrode 14. According to this constitution, it is capable of being obtained the effect identical with the second embodiment described-above with constitution of simple and low price.

Figure 5:
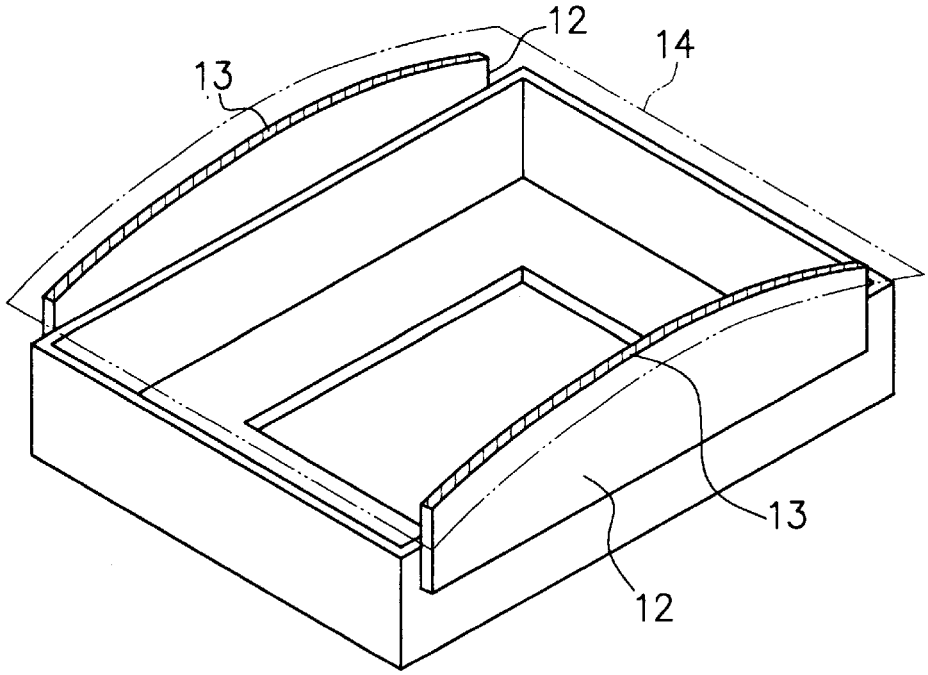
FIG. 5 is a perspective view showing a fifth embodiment of combination among a shadow mask electrode, a shadow mask electrode supporting body and a frame body of the present invention.

FIG. 5 is a perspective view showing a fifth embodiment of combination among a shadow mask electrode, a shadow mask electrode supporting body and a frame body of a color cathode ray tube of the present invention. The frame body 11 is an approximately rectangular. The shadow mask electrode supporting body 12 is firmly fixed to be supported on the two-sides of the frame body 11. A part of the shadow mask electrode supporting body 12 is protruded upward from the frame body 11 in the shape of half-moon. The shadow mask electrode supporting body 12 is firmly fixed to be supported to the frame body 11 by resistance welding, laser welding, hard-solder, rivet fastening, or staking. The shadow mask electrode 14 whose shape is the same as that of the shadow mask electrode supporting body 12 is firmly fixed to be supported on the supporting part 13 (hatching part) to be upper end face of the shadow mask electrode supporting body 12 by spot welding. Furthermore, the shadow mask electrode 14 roofs the whole opening at upper surface of the frame body 11. However, chain line indicates only the periphery part of four-side of the shadow mask electrode 14 in order to make the drawing easy to see. The thermal expansion rate of the metal for the shadow mask electrode 14 is approximately identical with the thermal expansion rate of the metal for the shadow mask electrode supporting body 12. A supporting part 13 (hatching part) for the plane shaped shadow mask electrode 14 is two sides in the lengthwise direction as shown in FIG. 5. Tension is applied to the shadow mask electrode only in the lengthwise direction. The shadow mask electrode 14 is made of Invar. There is no shadow mask electrode supporting body in the lateral direction. According to the constitution, it becomes possible to constitute the color cathode-ray tube with a low cost and lightweight. The fifth embodiment is different from that of the above described embodiments in that the shadow mask electrode has curved surface to be a part of side surface of a cylinder. The supporting part 13 (hatching part) of the shadow mask electrode supporting body 12 has a circular arc shape. The shadow mask electrode with curved surface rather than flat surface is easy to execute focussing of the electron beam. It is therefore capable of using a low price of electron gun and deflecting yoke. The present embodiment is adapted to the low cost color cathode ray tube. Further, when internal surface of the face panel 21 is perfectly plane, in some cases, picture center undergoes a hallucination that the picture center is a concave surface. Consequently, it may be desired that external surface of the face panel 21 is plane and internal surface thereof is a part of side surface of the cylinder namely which has curved surface. The present embodiment is appropriate to such case.

Figure 6:
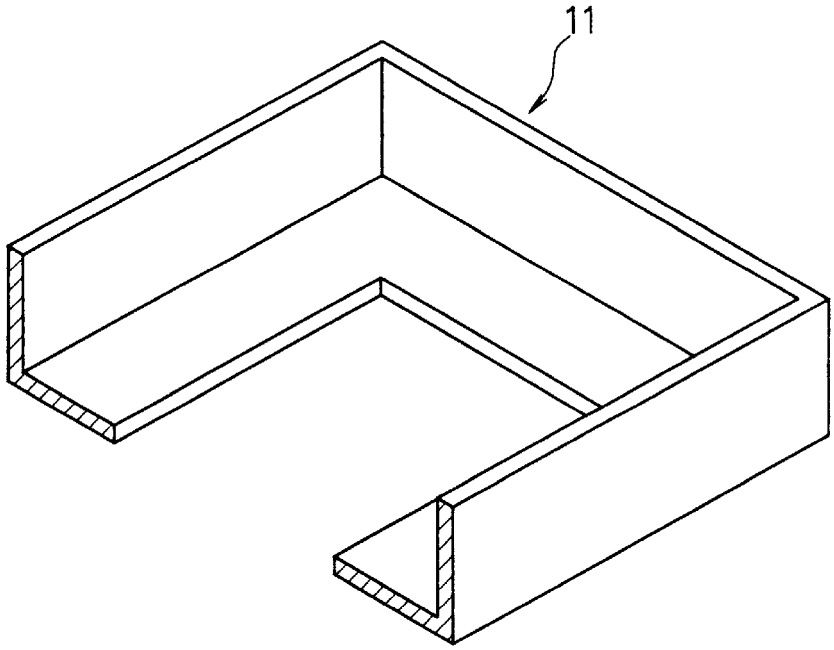
FIG. 6 is a sectional perspective view showing a first embodiment of a frame body of the color cathode-ray tube of the present invention.

Next, FIG. 6 is a sectional perspective view showing a first embodiment of a frame body of the color cathode-ray tube of the present invention. As shown in FIG. 6, the frame body 11 is an approximately rectangular as the whole shape. A section of the frame body is approximately L-shape. This shape is easy to manufacture with stamping out press-manufacturing. This shape has relatively high intensity. The frame body of this shape has a low price and practical use.

Figure 7:
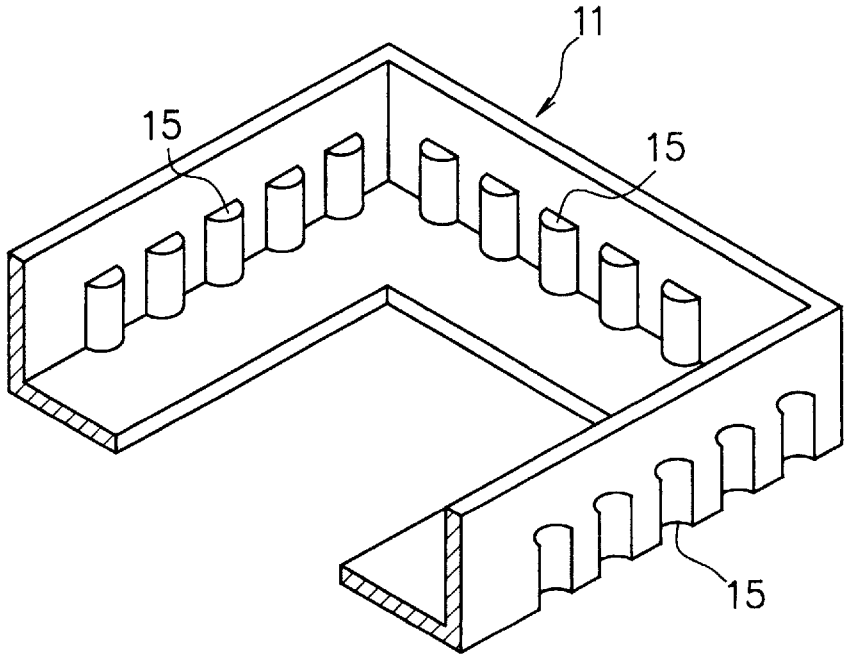
FIG. 7 is a sectional perspective view showing a second embodiment of a frame body of the color cathode-ray tube of the present invention.

FIG. 7 is a sectional perspective view showing a second embodiment of a frame body of the color cathode-ray tube of the present invention. As shown in FIG. 7, the frame body 11 is an approximately rectangular as the whole shape. A section of the frame body is approximately L-shape. There are provided embosses 15 on the side wall part. This shape has high intensity in comparison with the above-described first embodiment. This embodiment is appropriate to the case that the shadow mask electrode 14 requires more strong tension and/or the frame body 11 requires more light weight.

Figure 8:
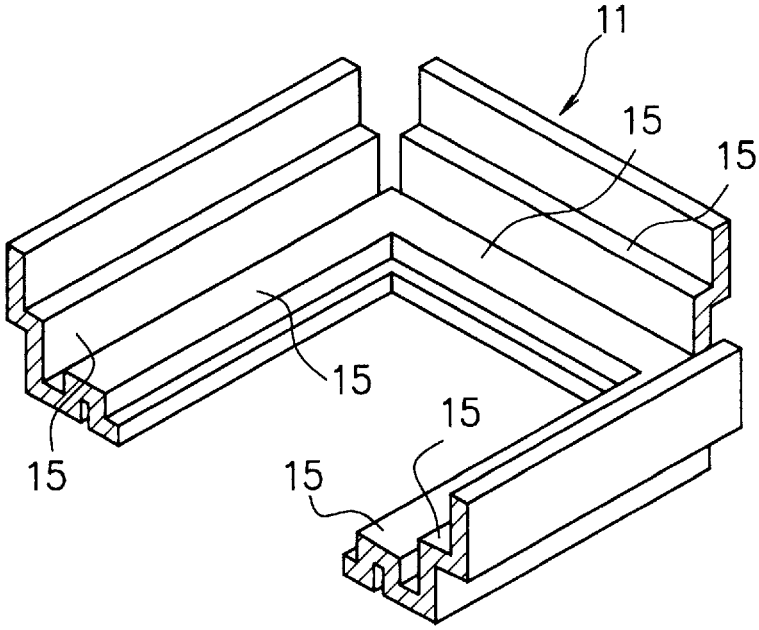
FIG. 8 is a sectional perspective view showing a third embodiment of a frame body of the color cathode-ray tube of the present invention.

FIG. 8 is a sectional perspective view showing a third embodiment of a frame body of the color cathode-ray tube of the present invention. As shown in FIG. 8, the frame body 11 is an approximately rectangular as the whole shape. A section of the frame body is approximately L-shape. There are provided embosses 15 on the side wall part and bottom part. This shape has high intensity in comparison with the above-described second embodiment in that the intensity of the bottom part is high. Torsion of the frame body 11 is hard to occur. This third embodiment is appropriate to the case that the shadow mask electrode 14 requires more strong tension and/or the frame body 11 requires more light weight.

Figure 9:
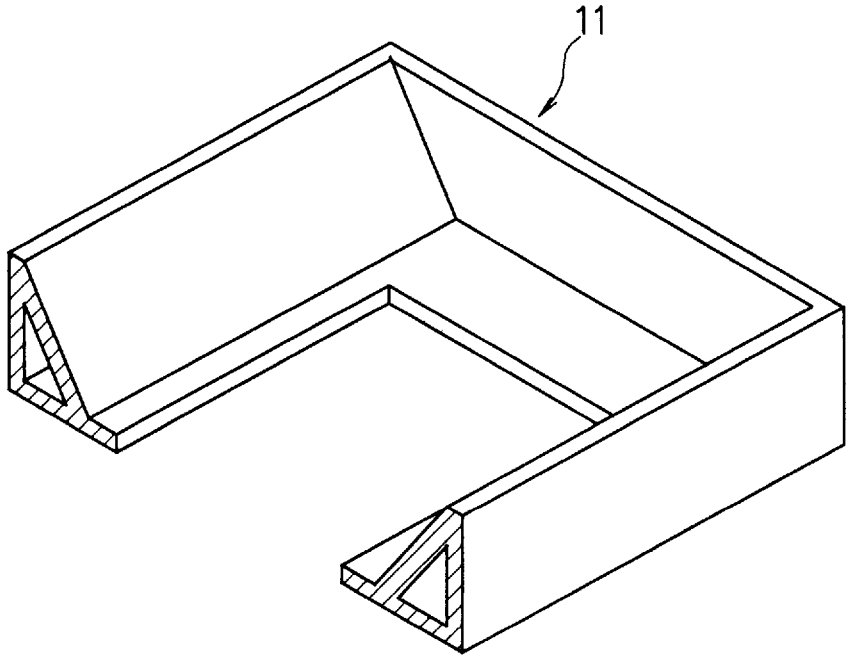
FIG. 9 is a sectional perspective view showing a fourth embodiment of a frame body of the color cathode-ray tube of the present invention.

FIG. 9 is a sectional perspective view showing a fourth embodiment of a frame body of the color cathode-ray tube of the present invention. As shown in FIG. 9, the frame body 11 is an approximately rectangular as the whole shape. A section in the longitudinal direction of the frame body is approximately triangle-shape. Manufacturing cost of this shape requires high cost in comparison with the above-described first, second, or third embodiment. Intensity of the frame body of the fourth embodiment is higher than that of the above-described respective embodiments. This fourth embodiment is appropriate to the case that the shadow mask electrode 14 requires more strong tension and/or the frame body 11 requires more light weight.

Figure 10:
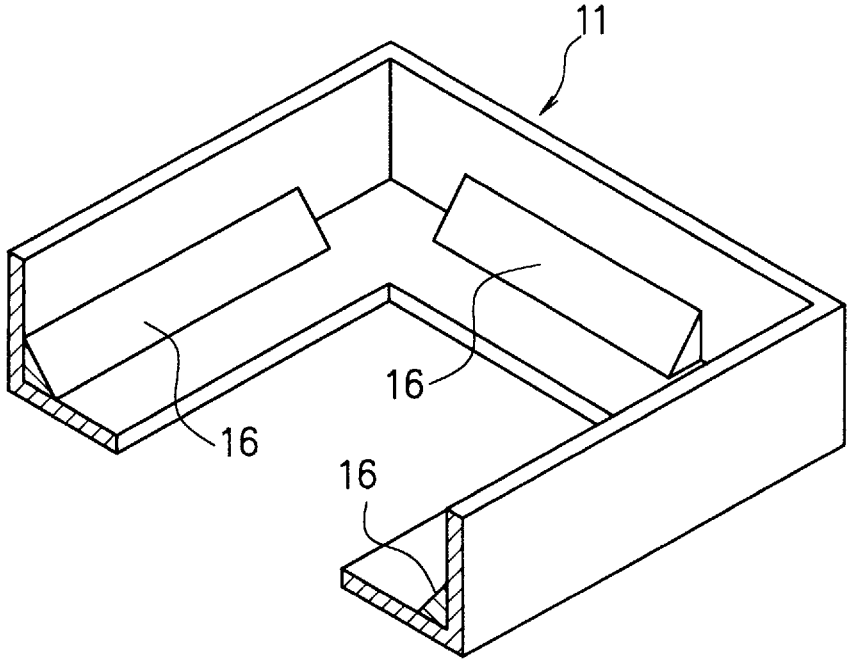
FIG. 10 is a sectional perspective view showing a fifth embodiment of a frame body of the color cathode-ray tube of the present invention.

FIG. 10 is a sectional perspective view showing a fifth embodiment of a frame body of the color cathode-ray tube of the present invention. As shown in FIG. 10, the frame body 11 is an approximately rectangular as the whole shape. A section of the frame body is approximately L-shape. Reinforcing members 16 are added to the respective sides. The shape of the fifth embodiment brings intensity approximately the same as that of the fourth embodiment. There is the feature that the manufacturing cost is relatively low cost.

Figure 11:
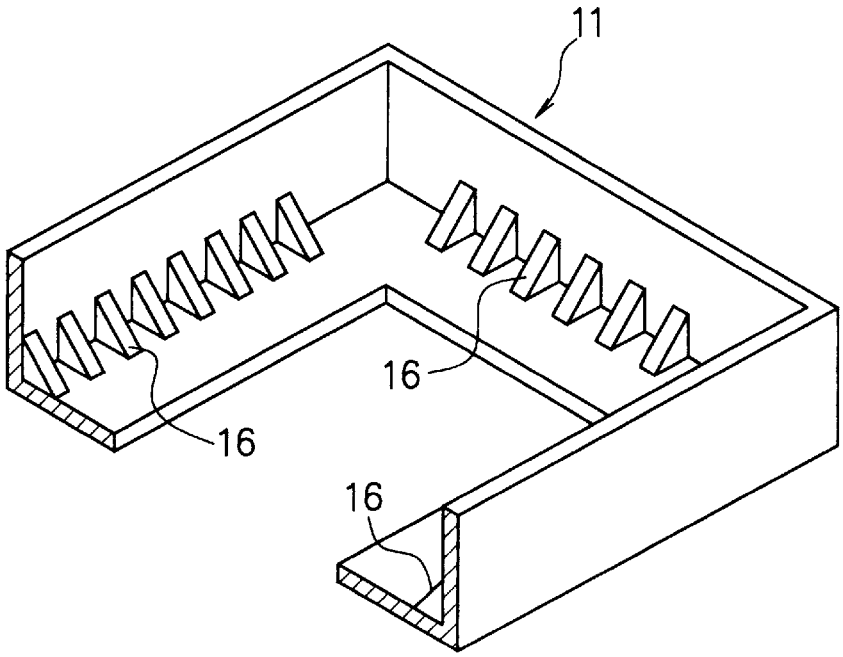
FIG. 11 is a sectional perspective view showing a sixth embodiment of a frame body of the color cathode-ray tube of the present invention.

FIG. 11 is a sectional perspective view showing a sixth embodiment of a frame body of the color cathode-ray tube of the present invention. As shown in FIG. 11, the frame body 11 is an approximately rectangular as the whole shape. A section of the frame body is approximately L-shape. Reinforcing members 16 are added to the respective sides. The shape of the sixth embodiment brings intensity approximately the same as that of the fifth embodiment. There is the feature that the light weight embodiment is obtained.

Figure 12:
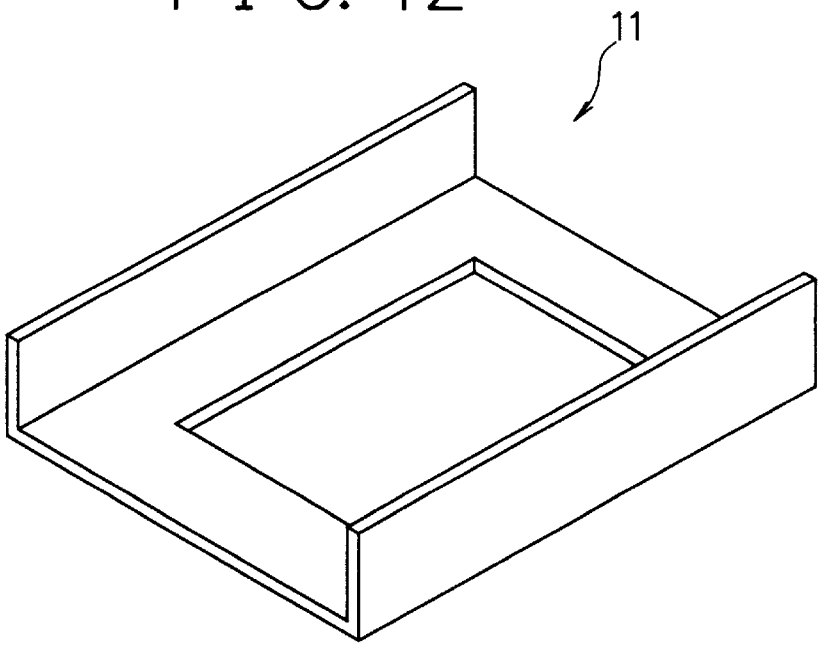
FIG. 12 is a perspective view showing a seventh embodiment of frame body of the color cathode-ray tube of the present invention.

FIG. 12 is a perspective view showing a seventh embodiment of frame body of the color cathode-ray tube of the present invention. In the present embodiment, with respect to four sides of the frame body, tension is applied to two sides which stand opposite each other, while tension is not applied to another two sides which stand opposite each other. In such the frame body, the shape of the two sides with tension is different from the shape of the two sides with no-tension as a first example. As shown in FIG. 12, the frame body 11 is an approximately rectangular as the whole shape. A section of the frame body is approximately L-shape. There is no standing up part concerning two sides which stand opposite each other to which tension is not applied. The present case is appropriate to the case where the tension to be applied is weak in comparison with the intensity of the frame body 11. There is the feature of light weight and low price.

Figure 13:
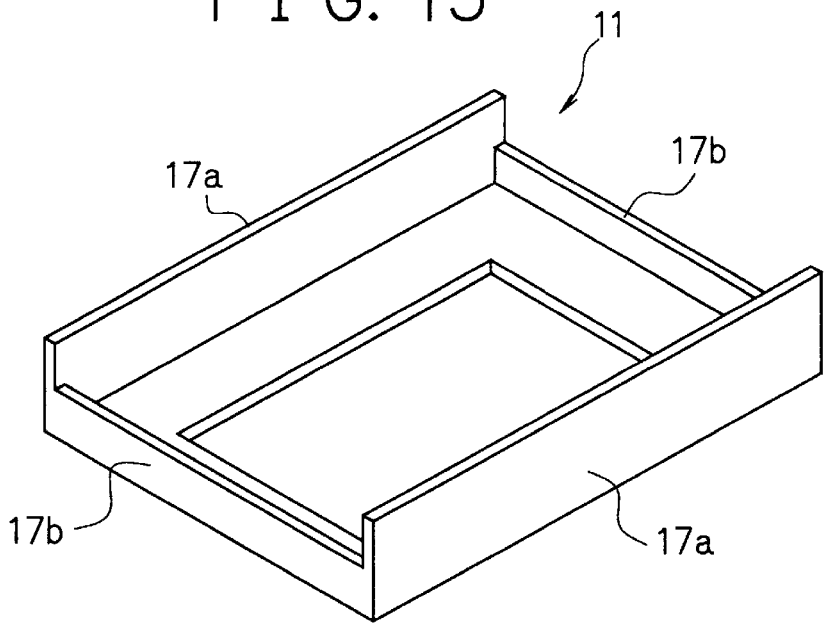
FIG. 13 is a perspective view showing an eighth embodiment of frame body of the color cathode-ray tube of the present invention.

FIG. 13 is a partial perspective view showing an eighth embodiment of frame body of the color cathode-ray tube of the present invention. In the present embodiment, with respect to four sides of the frame body, tension is applied to two sides which stand opposite each other, while tension is not applied to another two sides which stand opposite each other. In such the frame body, the shape of the two sides with tension is different from the shape of the two sides with no-tension as a second example. As shown in FIG. 13, the frame body 11 is an approximately rectangular as the whole shape. A section of the frame body is approximately L-shape. There are standing up part concerning two sides 17*b* which stand opposite each other to which tension is not applied. There are two sides 17*a* which stand opposite each other to which tension is applied. The standing up part of the opposite two sides 17*b* are lower than the opposite two sides 17*a*. The present case is appropriate to the case where the tension to be applied is slightly strong in comparison with the seventh embodiment. There is the feature of light weight and low price.

Figure 14:
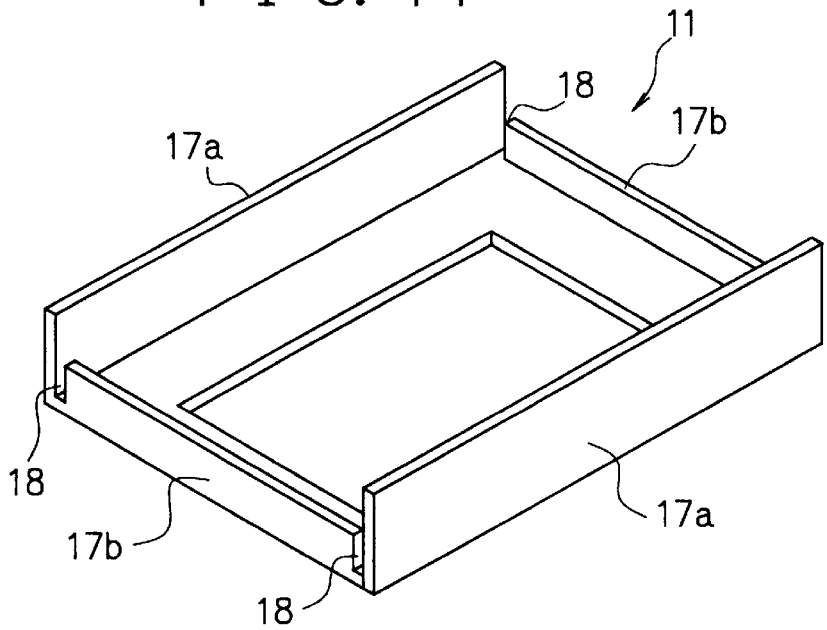
FIG. 14 is a perspective view showing a ninth embodiment of frame body of the color cathode-ray tube of the present invention.

FIG. 14 is a partial perspective view showing a ninth embodiment of frame body of the color cathode-ray tube of the present invention. In the present embodiment, with respect to four sides of the frame body, tension is applied to two sides which stand opposite each other, while tension is not applied to another two sides which stand opposite each other. In such the frame body, the shape of the two sides with tension is different from the shape of the two sides with no-tension as a third example. As shown in FIG. 14, the frame body 11 is an approximately rectangular as the whole shape. A section of the frame body is approximately L-shape. There are standing up part concerning two sides 17*b* which stand opposite each other to which tension is not applied. There are two sides 17*a* which stand opposite each other to which tension is applied. The standing up part of the opposite two sides 17*b* are lower than the opposite two sides 17*a*. Furthermore, there are provided a plurality of depth of cut 18 at a joint of respective sides. The depth of cut 18 exhibits the effect that it prevents occurrence of deformation such as distortion concerning the frame body 11 according to high temperature, in particular during manufacturing of the color cathode-ray tube.

In FIGS. 12 to 14, there is described the case where the shape of opposite two sides to which tension is applied is different from the shape of opposite sides to which tension is not applied. In FIGS. 7 to 11, there is described structure in order to improve intensity. Such structure of FIGS. 7 to 11 for improving intensity is effective for the case of FIGS. 12 to 14.

As described above, according to the present invention, improved constitution between the color selecting electrode and the frame body is realized with practical cost. The constitution does not cause deterioration of picture quality by difference of expansion and contraction according to difference of the thermal expansion rate between the shadow mask electrode and the frame.

While preferred embodiments of the invention have been described using specific terms, the description has been illustrative purposes only, and it is to be understood that changes and variations may be made without departing from the spirit or scope of the following claims.

What is claimed is:

1. A color cathode-ray tube comprising:

a shadow mask electrode made of metal whose thermal expansion rate is low and to which tension is applied to be flatly supported;

a color electrode supporting body made of metal whose thermal expansion rate is substantially the same as that of said shadow mask electrode, for supporting said shadow mask electrode; and a frame body made of metal whose thermal expansion rate is different from that of said shadow mask electrode, for supporting said shadow mask electrode supporting body.

2. A color cathode-ray tube as claimed in claim 1, wherein tension in one-way direction is applied to said shadow mask electrode to be flatly supported.

3. A color cathode-ray tube as claimed in claim 2, wherein tension in one-way direction is applied to said shadow mask electrode to be flatly supported, and there is provided said shadow mask electrode supporting body for only two sides which stand opposite each other for applying tension to said shadow mask electrode.

4. A color cathode-ray tube as claimed in claim 1, wherein shape of said shadow mask electrode is a part of side surface of a cylinder.

5. A color cathode-ray tube as claimed in claim 2, wherein shape of said shadow mask electrode is a part of side surface of a cylinder.

6. A color cathode-ray tube as claimed in claim 3, wherein shape of said shadow mask electrode is a part of side surface of a cylinder.

7. A color cathode-ray tube as claimed in claim 1, wherein shape of said frame body is rectangular.

8. A color cathode-ray tube as claimed in claim 2, wherein shape of said frame body is rectangular.

9. A color cathode-ray tube as claimed in claim 3, wherein shape of said frame body is rectangular.

10. A color cathode-ray tube as claimed in claim 4, wherein shape of said frame body is rectangular.

11. A color cathode-ray tube as claimed in claim 1, wherein said frame body is approximately rectangular and said frame body has a section, wherein a part of said section or the whole of said section is L-shaped.

12. A color cathode-ray tube as claimed in claim 2, wherein said frame body is approximately rectangular and said frame body has a section, wherein a part of said section or the whole of said section is L-shaped.

13. A color cathode-ray tube as claimed in claim 3, wherein said frame body is approximately rectangular and said frame body has a section, wherein a part of said section or the whole of said section is L-shaped.

14. A color cathode-ray tube as claimed in claim 4, wherein said frame body is approximately rectangular and said frame body has a section, wherein a part of said section or the whole of said section is L-shaped.

15. A color cathode-ray tube as claimed in claim 7, wherein said frame body is approximately rectangular and said frame body has a section, wherein a part of said section or the whole of said section is L-shaped.

16. A color cathode-ray tube as claimed in claim 1, wherein there is provided a reinforcing member, wherein said member is on a part of said frame body or is on the whole of said frame body.

17. A color cathode-ray tube as claimed in claim 2, wherein there is provided a reinforcing member, wherein said member is on a part of said frame body or is on the whole of said frame body.

18. A color cathode-ray tube as claimed in claim 3, wherein there is provided a reinforcing member, wherein said member is on a part of said frame body or is on the whole of said frame body.

19. A color cathode-ray tube as claimed in claim 4, wherein there is provided a reinforcing member, wherein said member is on a part of said frame body or is on the whole of said frame body.

20. A color cathode-ray tube as claimed in claim 7, wherein there is provided a reinforcing member, wherein said member is on a part of said frame body or is on the whole of said frame body.

21. A color cathode-ray tube as claimed in claim 1, wherein a part of said frame body or the whole of said frame body is manufactured by stamping out press processing.

22. A color cathode-ray tube as claimed in claim 2, wherein a part of said frame body or the whole of said frame body is manufactured by stamping out press processing.

23. A color cathode-ray tube as claimed in claim 3, wherein a part of said frame body or the whole of said frame body is manufactured by stamping out press processing.

24. A color cathode-ray tube as claimed in claim 4, wherein a part of said frame body or the whole of said frame body is manufactured by stamping out press processing.

25. A color cathode-ray tube as claimed in claim 7, wherein a part of said frame body or the whole of said frame body is manufactured by stamping out press processing.

26. A color cathode-ray tube as claimed in claim 11, wherein a part of said frame body or the whole of said frame body is manufactured by stamping out press processing.

27. A color cathode-ray tube as claimed in claim 16, wherein a part of said frame body or the whole of said frame body is manufactured by stamping out press processing.

28. A color cathode-ray tube as claimed in claim 1, wherein said shadow mask electrode and said shadow mask electrode supporting body which applies tension to said shadow mask electrode are made of nickel-iron alloy including nickel of 34% to 40% and optionally further comprising a slight amount of addition elements, and said frame body is made of steel, stainless steel, or a combination thereof.

29. A color cathode-ray tube as claimed in claim 4, wherein said shadow mask electrode and said shadow mask electrode supporting body which applies tension to said shadow mask electrode are made of nickel-iron alloy including nickel of 34% to 40% and optionally further comprising a slight amount of addition elements, and said frame body is made of steel, stainless steel, or a combination thereof.

30. A color cathode-ray tube as claimed in claim 5, wherein said shadow mask electrode and said shadow mask electrode supporting body which applies tension to said shadow mask electrode are made of nickel-iron alloy including nickel of 34% to 40% and optionally further comprising a slight amount of addition elements, and said frame body is made of steel, stainless steel, or a combination thereof.

31. A color cathode-ray tube as claims in claim 6, wherein said shadow mask electrode and said shadow mask electrode supporting body which applies tension to said shadow mask electrode are made of nickel-iron alloy including nickel of 34% to 40% and optionally further comprising a slight amount of addition elements, and said frame body is made of steel, stainless steel, or a combination thereof.

* * * * *